US011031179B2

(12) United States Patent
Rivas Davila et al.

(10) Patent No.: US 11,031,179 B2
(45) Date of Patent: Jun. 8, 2021

(54) PASSIVE COMPONENTS FOR ELECTRONIC CIRCUITS USING CONFORMAL DEPOSITION ON A SCAFFOLD

(71) Applicant: The Board of Trustees of the Leland Stanford Junior University, Palo Alto, CA (US)

(72) Inventors: Juan M. Rivas Davila, Palo Alto, CA (US); Wei Liang, Stanford, CA (US); Luke C. Raymond, Stanford, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 257 days.

(21) Appl. No.: 15/508,453

(22) PCT Filed: Sep. 2, 2015

(86) PCT No.: PCT/US2015/048140

§ 371 (c)(1),
(2) Date: Mar. 2, 2017

(87) PCT Pub. No.: WO2016/036854

PCT Pub. Date: Mar. 10, 2016

(65) Prior Publication Data

US 2017/0287633 A1 Oct. 5, 2017

Related U.S. Application Data

(60) Provisional application No. 62/044,669, filed on Sep. 2, 2014.

(51) Int. Cl.

| | |
|---|---|
| ***H01F 7/06*** | (2006.01) |
| ***H01F 41/04*** | (2006.01) |
| ***H01F 17/06*** | (2006.01) |

(52) U.S. Cl.
CPC ..... *H01F 41/04* (2013.01); *H01F 17/06* (2013.01)

(58) Field of Classification Search
CPC ..... H01F 17/06; H01F 41/04
See application file for complete search history.

(56) References Cited

U.S. PATENT DOCUMENTS

| | | | | |
|---|---|---|---|---|
| 3,850,762 A * | 11/1974 | Smith | B01D 61/145 205/203 |
| 6,275,132 B1 * | 8/2001 | Shikama | H01F 27/29 29/602.1 |
| 6,614,338 B2 * | 9/2003 | Hamatani | H01F 17/045 336/192 |
| 6,880,232 B2 | 4/2005 | La Valle | |

(Continued)

FOREIGN PATENT DOCUMENTS

| | | | |
|---|---|---|---|
| DE | 3615307 A1 * | 11/1987 | H05K 3/303 |
| WO | WO2010093761 | 8/2010 | |

OTHER PUBLICATIONS

Cantillon-Murphy Development of Three-Dimensional Passive Components for Power Electronics. MIT 2005 relevant pp. 15-16, 71. https://dspace.mit.edu/handle/1721.1/34679#files-area.

*Primary Examiner* — Paul D Kim
(74) *Attorney, Agent, or Firm* — Crawford Maunu PLLC

(57) ABSTRACT

Precision fabrication of 3D objects is used for fabricating passive electrical components. A 3D scaffold is fabricated and then electrically conductive and/or insulating layers are deposited on the scaffold to form the electrical component.

10 Claims, 8 Drawing Sheets

(56) References Cited

U.S. PATENT DOCUMENTS

| | | | | |
|---|---|---|---|---|
| 7,525,405 | B2 * | 4/2009 | La Valle | H01F 17/04 336/83 |
| 8,789,262 | B2 * | 7/2014 | Liu | H01F 27/292 29/592.1 |
| 2008/0149299 | A1 | 6/2008 | Slaughter | |
| 2011/0199175 | A1 | 8/2011 | Mino | |
| 2011/0310530 | A1 * | 12/2011 | Laor | B01J 37/0238 361/524 |
| 2013/0170171 | A1 | 7/2013 | Wicker | |
| 2015/0360463 | A1 * | 12/2015 | Sadwick | H01J 23/165 347/110 |

* cited by examiner

PASSIVE COMPONENTS FOR ELECTRONIC CIRCUITS USING CONFORMAL DEPOSITION ON A SCAFFOLD

CROSS-REFERENCE TO RELATED APPLICATIONS

This application is a 371 of PCT application PCT/US2015/048140 filed on Sep. 2, 2015. PCT/US2015/048140 filed on Sep. 2, 2015 claims the benefit of U.S. Provisional application 62/044,669 filed on Sep. 2, 2014.

FIELD OF THE INVENTION

This invention relates to passive electronic components and their fabrication.

BACKGROUND

Conventional fabrication of passive electronic components such as resistors, inductors and capacitors often relies on low precision manufacturing processes. For example, inductors are often simply fabricated from a coil of wire having a more or less poorly defined shape. The resulting components tend to have poorly controlled component values, which is undesirable.

As described in greater detail below, attempts have been made to provide precision fabrication of electronic components using printed circuit board technology. The constraints imposed by that technology on designs tend to be burdensome. Another approach for electrical component fabrication is considered in U.S. Pat. No. 6,880,232, where inductors are fabricated via lost-wax casting to provide improved control of inductor shape.

It would be an improvement in the art to provide improved approaches for precision fabrication of passive electrical components.

SUMMARY

Precision fabrication of 3D objects is used for fabricating passive electrical components. In some embodiments a 3D scaffold is fabricated and then electrically conductive and/or insulating layers are deposited on the scaffold to form the electrical component.

DETAILED DESCRIPTION

Figure 1:
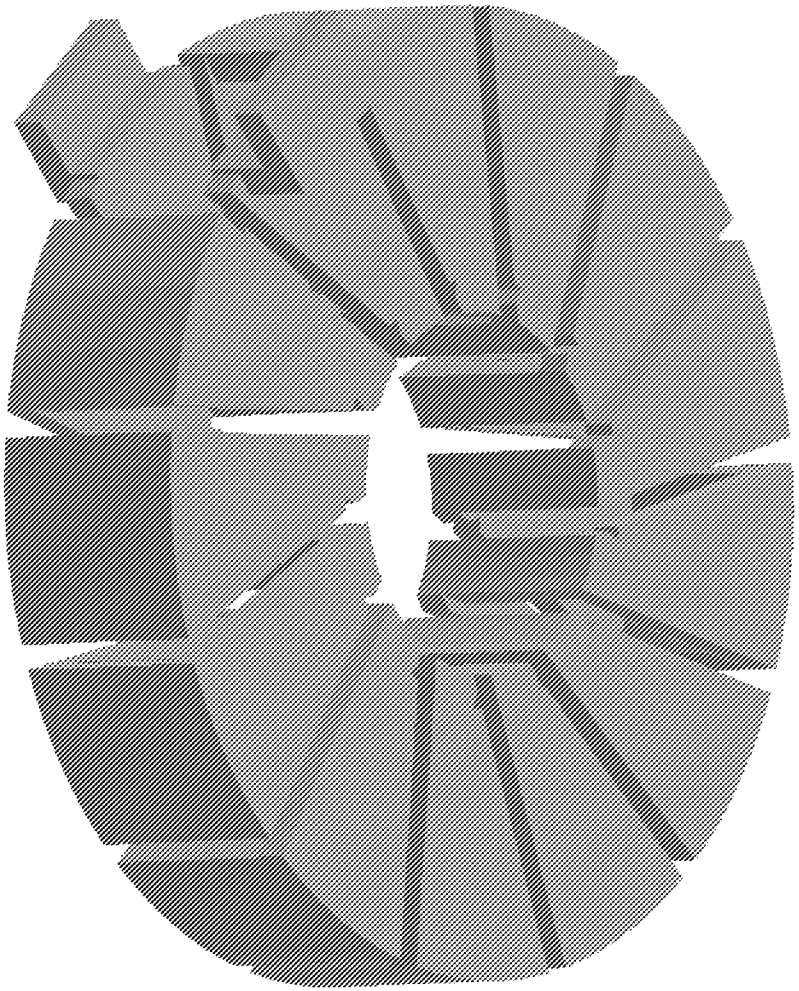
FIG. 1 shows a 3D computer aided design (CAD) model of a toroid inductor with a square cross section.

Section A of this description covers general principles relating to embodiments of the invention. Section B of the description considers several examples.

A) GENERAL PRINCIPLES

Embodiments of the invention generally make use of the ability of 3D fabrication methods to provide precise control of component shape, thereby providing similarly precise control of component electrical properties.

One embodiment of the invention is a method of making an electrical component, where the method includes the steps of:

1) providing a scaffold having one or more surfaces having predetermined 3-dimensional shapes, and
2) conformally depositing one or more layers on some or all of the surfaces of the scaffold having predetermined 3-dimensional shapes.

Here a surface has a "3-dimensional shape" if the surface is substantially non-planar. Conventional planar technology for semiconductor devices is not included in this definition because such technology is basically planar with only small and incidental departures from perfect planarity.

The scaffold can be configured as any shape, including but not limited to: coils and toroidal coils. The scaffold can be electrically insulating or electrically conductive. Similarly, the deposited layers can be either insulating or conductive. For example, the scaffold can be electrically insulating and the deposited layers can be conductive layers disposed on opposite surfaces of the scaffold and insulated from each other by the scaffold, thereby providing a transformer. As another example, the scaffold can be electrically conductive and the deposited layers can include insulating layers disposed on opposite surface of the scaffold and conductive layers disposed on the insulating layers, thereby providing a transformer. In this example, the scaffold could be the primary winding and the conductive layers would be two secondary windings.

In general, we define an electrical component as a passive circuit element or a passive electrical circuit. This includes capacitors, inductors, transformers, resistors and any combination thereof.

In cases where the electrical component is an inductor, it is preferred for the coil of the inductor to have a round cross section. This is advantageous and is in sharp contrast with the square or rectangular coil cross sections (i.e., coil cross sections having undesirable corners) that are typically obtained by conventional planar technology approaches for inductor fabrication.

The precise control of exact component shape that can be obtained in this way can be used to mitigate parasitic circuit elements in various ways. For example, some or all of the parasitic circuit elements can have parameter values determined by design of the scaffold. Here we define parasitic circuit elements as any circuit elements of a design other than a primary function as a capacitor or inductor. Such parasitic circuit elements are inevitable in practice, so being able to precisely control and/or mitigate their effects can be highly advantageous.

For example, an inductor can have a toroidal coil that mitigates a parasitic "one-turn" inductance by having current flow both clockwise and counter-clockwise with respect to a toroid of the toroidal coil. This approach can be extended to structures having two (or more) toroidal coils disposed in intersecting planes, each coil canceling its "one-turn" inductance as described above. Toroidal coils disposed in parallel planes can cancel their respective one-turn inductances by having current flow clockwise in one of the coils and counter-clockwise in the other coil.

Any fabrication method suitable for precision fabrication of suitable scaffolds can be employed, including but not limited to: 3-D printing, injection molding, casting and lost wax casting. Suitable 3D printing methods include but are not limited to: fused deposition modeling, stereo-lithography and selective laser sintering.

In some cases, the scaffold itself is used to form the desired electrical component, without the further deposition of layers on the scaffold. For example, the electrical component can be formed by using the scaffold as sacrificial material in a lost wax casting process. Most of the examples given below relate to this approach. These examples also serve as proof of concept for embodiments having layer deposition on the scaffold.

B) EXAMPLES

B1) Introduction

An ever increasing demand for portable electronics provides an incentive to reduce the size of power converters, which often times dominate the overall size of a system. Advances in semiconductors, control, circuit topologies and passive component design have enabled increases in switching frequency by two orders of magnitude in the past few decades. These advances are in part responsible for the reduction in size of today's power converters. Recent work on resonant converters has pushed switching frequencies even higher, exceeding 10 MHz and even into the Very High Frequency (VHF) range. Increasing switching frequency fundamentally reduces energy storage requirements and leads to improvements in miniaturization. Moreover, switching frequencies above tens of MHz allow the use of air core inductors that are comparable in size to their cored counterparts at lower frequencies.

Air core inductors are simple devices that depending on the circuit requirements and fabrication constraints can be realized in multiple ways. Previous implementations by the authors have used wire wound solenoids and toroids. These inductor implementations are simple and provide limited tuning flexibility, but they have significant limitations: They have low copper utilization due to skin effect at the switching frequency, which forces the current to flow on the very outer sheet of conductor, leaving the bulk of the copper un-utilized. Also, the effective volume occupied by the solenoid needs to include the volume of the magnetic field that can extend to several times the physical volume of the conductor. A wire wound toroid constrains the bulk magnetic flux to the torus thus reducing coupling to other components. But the constant diameter conductor leads to poor copper coverage at the outer diameter causing magnetic flux leakage. The present authors have used folded foil and milling techniques to improve copper coverage and performance of air core toroids for high frequency converters.

Air core toroids can be implemented using traces on printed circuit boards (PCBs). Although such PCB-based air-core toroids can have their designs optimized to improve high frequency performance, such design remains challenging.

Photolithography has been used to implement high Q air core inductors by other workers. These inductors provide very good copper coverage and optimize the geometry of low-turn inductors. Moreover, by this approach, these workers eliminate the leakage flux from the "one-turn" inductance of the structure caused by circumferential current. Additionally, the removal of the "one-turn" inductance significantly reduces coupling between nearby structures which helps address Electro-Magnetic Interference (EMI) issues. The high Q toroids of this approach have sub-optimal aspect ratios due to height limitations intrinsic to the fabrication approach.

Laminar fabrication techniques have height limitations which tend to lead to non-ideal aspect ratios of the magnetic structures. These processes further constrain geometries to only square cross sections with right angles, also contributing to suboptimal performance. Hence, although the above mentioned planar processes present an important improvement, their two dimensional nature can be constraining. In this work, we move away from constrained laminar fabrication methods and instead use additive manufacturing techniques to design passive components for high frequency power electronics converters. Specifically we provide examples of air core inductors that have rounded cross sections, excellent copper coverage and greater design flexibility. Moreover, we demonstrate inductive structures that can not be manufactured through conventional laminar processes but yield small inductance values with relatively high Q.

Furthermore, additive manufacturing combined with plating processes such as sputtering or selective electroplating can yield more complex passive structures capable of providing electrical isolation, or enhanced thermal performance.

Section B2 describes the design, modeling and fabrication process of the 3D printed air core inductors later used in a prototype. In this section, we also describe how the 3D models are imported into Finite Element Analysis (FEA) software to analyze and compare the electromagnetic field distribution, and predict electrical performance parameters. We also show some exemplary structures that highlight the variety of structures that can be easily manufactured with 3D printing techniques. Further details of the prototype and experimental results are shown in Section B3. Section B4 concludes this section.

B2) 3D Printed Air Core Inductors

Advances in 3D printing technologies are happening at a very rapid pace. The widespread popularity of 3D printing for rapid prototyping has led to dramatic reductions in system costs. Moreover, accessibility to 3D printing technologies is becoming widespread through the advent of online businesses that provide 3D printing services in a variety of materials. This revolution has generated opportunities for creative research applications requiring complex geometries.

This work takes advantage of the accessibility of low cost 3D printing techniques and applies them to the manufacture of air core components suitable for high frequency switching power converters. Furthermore, a variety of techniques such as metallized plating, casting in metal, or direct metal printing allows for the generation of multi-function passive components with desirable electrical, mechanical, and thermal properties.

B2a) 3D Printing Process

There are several types of 3D printing techniques, but the ones most relevant to this work include:

1) Fused Deposition Modeling (FDM): an additive manufacturing technique in which an extruded thermoplastic filament (commonly ABS or PLA) is passed through a heated nozzle, and the printing head deposits fused material selectively layer by layer in the X-Y coordinates of a heated plate to form the 3D model.

2) Stereo-lithography (SLA): an additive manufacturing technique in which a 3D object is printed out of thin layers of a "light" curable material. The laser cures points at the surface of a liquid resin which forms a layer of the 3D object, which is subsequently drown out by a layer thickness and repeat the process.

3) Selective laser sintering (SLS): a high power laser or electron beam fuses small beads of material to form a layer of complex 3D objects. Material not sintered in a layer serves as support material for subsequent layers, allowing the inclusion of overhang structures without the need of a different support material. Commercial systems now use printing materials that include plastics polymers (nylon, polystyrene) and metals (steel, titanium, other alloys).

With currently available 3D printing technology, systems printing in thermoplastics and resins are far more affordable and available than systems that directly print in metal. So metallization of non-conductive models is preferred for practical manufacturing of 3D printed circuit components. Specifically, lost-wax casting is used for the realization of the 3D printed inductors described in this work. It is expected that as interest in metal 3D printing increases, there will be more available options for direct manufacturing of some passive circuit components that may include the deposition of magnetic materials.

An exemplary process begins with a 3D CAD model describing the geometry for the desired component. In the second step, we use a 3D printer to build a model of the component in a castable material. For example, the model can be printed in resin using a low cost stereo-lithography 3D printer from Formlabs.

The castable model is then used to make a plaster casting mold for use in lost-wax casting techniques common to making jewelry. For example, the component can be cast in sterling silver, which has very good electrical and thermally conductivity. Companies such as i.materialise and Shapeways offer online 3D printing and casting services for jewelry items in precious metals like silver and gold. The casting of the inductors presented in this work were done using their services.

For the examples presented in this work, we were somewhat limited by the manufacturing guidelines of i.materialise and Shapeways. Because of this, we were not able to optimize some component parameters such as supporting wall thickness and interwinding separation for our air core inductors. We do not consider these limitations as fundamental, but practical and specific to the constrains of low cost online manufacturing. Direct laser metal sintering can also be used to make some of the magnetic structures described here, but because of its high cost it was not considered here.

There are alternative ways of realizing the 3D air core inductors described in this section. As mentioned in Section B1, the method currently under investigation by the authors is to print the shape of the desired passive component in a non-metallic material (ABS, resin, etc.) and use electro-deposition techniques to plate the desired surfaces thus conferring the desired electrical characteristics to the structure.

This technique is very promising as it allows the plating of thin surfaces comparable to the skin depth of the ac current flowing through a given component at a designed switching frequency. This method may also offer additional benefits as it may help reduce the cost and weight of the component, at the expense of thermal mass. Moreover, it allows for the use of the sequential application of conductive and insulating layers for the formation of the primary and secondary of an isolated 1:1 air core transformers with very good coupling.

We also consider the 3D printing of electronic components and structures that go beyond the air core inductors described here. Specifically we are considering the design of parts with the following attributes: a) combined 3D structures that incorporate parasitic capacitances and inductances as tuning parameters in the design of an air core high-frequency power converter; b) implementation of high frequency isolation trans-formers by selective electro-deposition; and c) the capacity to add structural texture to enhance cooling capabilities, thus turning component into a heat sink or an EMI shield.

B2b) Software Toolchain

Software for PCB circuit design is well developed and there are many choices available for hobbyists and professionals alike. However, a software toolchain for 3D circuit design has not been developed. For this work we looked into ways of modeling the 3D components for fabrication, but also to analyze the electrical characteristics and the distribution of the magnetic field and the current density within the structures, so that the elements can be properly incorporated into a power electronics design.

The 3D CAD models for 3D printing were developed in OpenJSCAD, a script based online compiler and OpenSCAD, a script based 3D CAD modeler. Script-based CAD software offers more flexibility in our designs as it saves time compared to hand-drawn CAD software especially when multiple iterations are required in the optimization of the component's geometries. Once the design is finished, a 3D CAD model (usually in a .stl format) can be readily used for 3D printing.

In order to evaluate performance before manufacture we are also interested in creating an effective FEA model for simulation. In this step, converting from a 3D printing compatible CAD file such as an .stl file to an FEA compatible CAD file presents a problem. Since .stl file and other file formats specific for 3D printing only model the surface mesh of the objects, they do not have enough information for FEA analysis. There are various ways to convert a mesh file to a solid. In this work, we use a open source CAD software FreeCAD to convert part of the CAD model from mesh to solid and then import it directly to the FEA software (COMSOL Multiphysics in this work). With part of the model already imported, geometry manipulation in COMSOL Multiphysics allows the exact reconstruction of the geometry and thus the FEA analysis for the designed component. The simulated electromagnetic distribution is important for EMI predictions of the whole converter system, especially for unconventional geometries. With the FEA results and a few iterations, the 3D CAD model is finalized and sent to the 3D printer.

B2c) Examples

1) A toroid with a square cross section: As an example of 3D printed inductors, FIG. 1 shows the OpenSCAD CAD model of a square cross section toroid. The vertical connecting walls are solid compared to an array of wires as in the above-described PCB toroid work. Moreover, the ability to adjust the toroid height allows for designs with a better quality factor. Table I lists the measured and simulated inductances and quality factors Q. Note that the mismatch of the measured and simulated quality factor is due to the cast silver used in i.materialise and Shapeways. The measured cast silver conductivity is about 37% of pure copper. Thus it results in lower than expected measured quality factors. However, since we prefer surface copper plating to sterling silver casting for metallization, we do not think this is a major obstacle for the technology development but rather specific to the manufacturing process we chose for simplicity in this particular experiment.

TABLE I

Simulated vs. measured characteristics of the inductor in FIG. 1. The difference between simulated Q and measured Q is attributed to the cast silver used in these experiments as described above.

| | L @ 27.12 MHz nH | Q @ 27.12 MHz | Q @ 54.24 MHz | Q @ 81.36 MHz |
|---|---|---|---|---|
| simulation | 84.6 | 135 | 187 | 226 |
| measurement | 81 | 68 | NA | NA |

Figure 2:
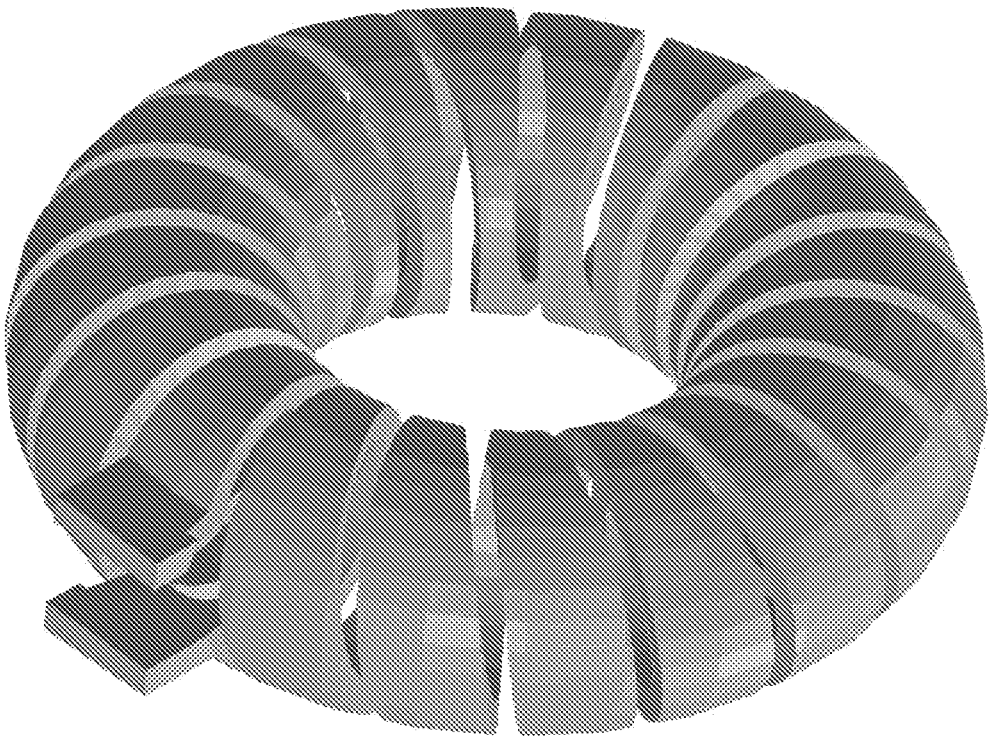
FIG. 2 is a 3D CAD model of a toroid inductor with a round cross section.

2) A toroid with a round cross section: FIG. 2 shows a round cross section toroid inductor. The inductor in FIG. 2 was compared with its rectangular cross section counterpart of FIG. 1 in COMSOL Multiphysics. Table II lists the measured and simulated inductances and quality factors Q. Table III details the characteristics of the two inductors for comparison. It is clear that the inductor in FIG. 2 does not have straight cuts but follows the curved surface of a spiral, something not possible in a laminar fabrication process. The circular cross section is not optimal, but chosen in part because it was simple to describe in the 3D modeling software for 3D printing. Future work will look into optimizing the cross section for minimum loss under geometric constraints. Using 3D printing, it is straight forward to fabricate an air core inductor with an optimal cross section once the CAD model is developed.

TABLE II

Simulated vs. measured characteristics of the inductor in FIG. 2. The difference between simulated Q and measured Q is attributed to the cast silver used in these experiments as described above.

| | L @ 27.12 MHz nH | Q @ 27.12 MHz | Q @ 54.24 MHz | Q @ 81.36 MHz |
|---|---|---|---|---|
| simulation | 341 | 236 | 313 | 355 |
| measurement | 345 | 125 | NA | NA |

TABLE III

Simulation comparison of round inductor in FIG. 2 and its rectangular counterpart in FIG. 1.

| | Round | Rectangular |
|---|---|---|
| outer diameter (OD) | 29 mm | 29 mm |
| inner diameter (ID) | 11 mm | 12 mm |

TABLE III-continued

Simulation comparison of round inductor in FIG. 2 and its rectangular counterpart in FIG. 1.

| | Round | Rectangular |
|---|---|---|
| height (h) | 9 mm | 9 mm |
| turns (N) | 20 | 19 |
| wall thickness | 1 mm | 1 mm |
| $L_{sim}$ @ 27.12 MHz | 341 nH | 365 nH |
| Q @ 27.12 MHz | 236 | 217 |

3) A toroid with a round cross section and two parallel windings: Previous work demonstrates the cancellation effect of the "one-turn" inductance caused by the circumferential current in an air core inductor. Specifically, paralleling two winding legs cancels the magnetic field caused by the circumferential current on each leg. However, earlier work on manufacturing components according to this principle resulted in air core inductors with rectangular cross section with a low vertical/width ratio. The geometry in FIG. 3 was designed to have a round cross section while achieving the same "one-turn" cancellation effect. Current flow in this inductor is schematically shown on FIG. 4, and cancellation of the "one turn" inductance is provided by splitting current flow such that current flows both clockwise and counter-clockwise with respect to the toroid of the toroidal coil. COMSOL Multiphysics simulations demonstrate that the magnetic field in the vertical direction is a much smaller portion of the whole field distribution compared with the normal toroid inductors of FIGS. 1 and 2.

TABLE IV

Figure 3:
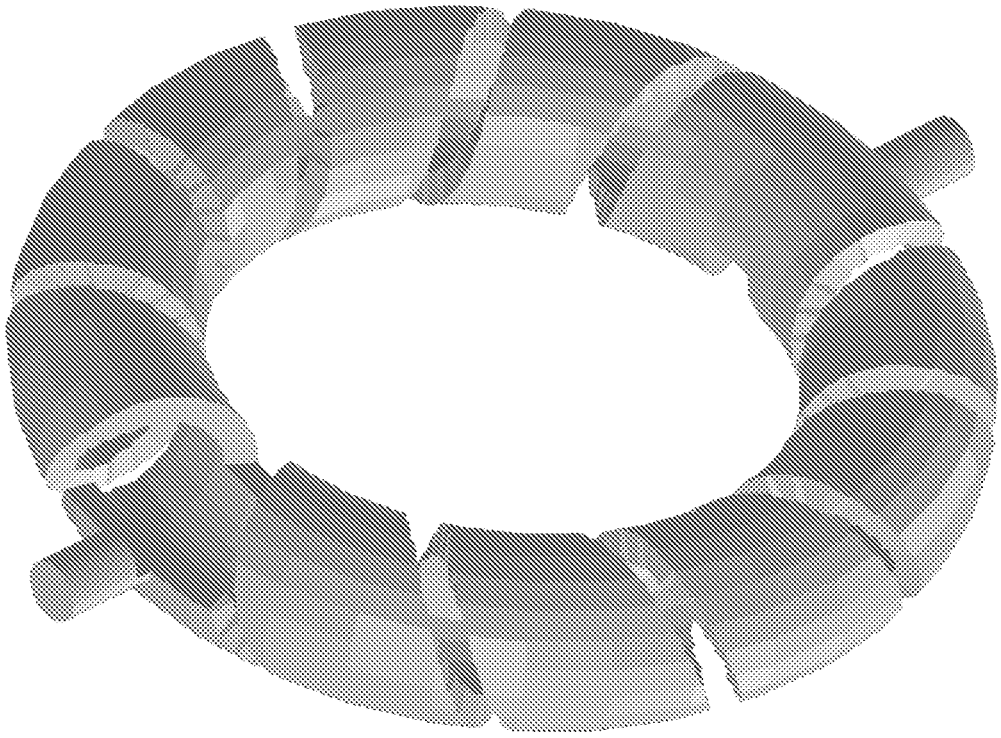
FIG. 3 is a 3D CAD model of a toroid inductor with a round cross section and two parallel windings.
Figure 4:
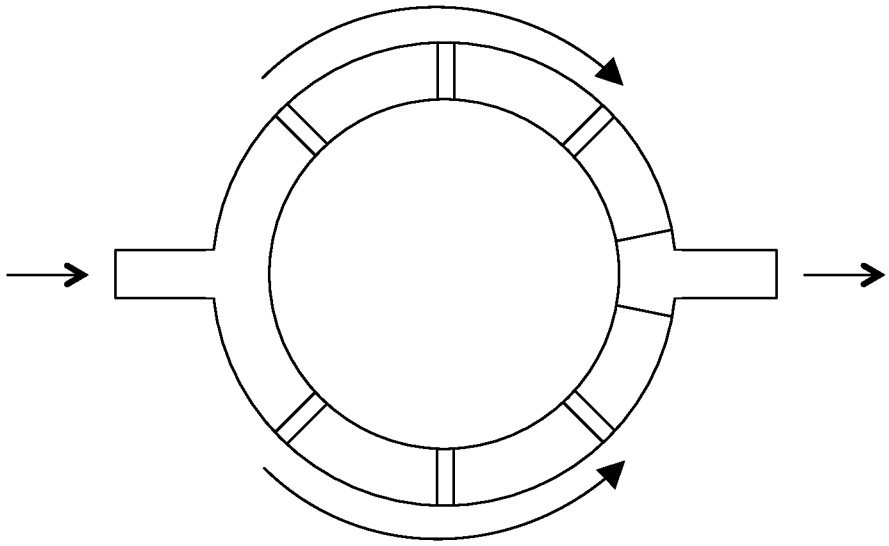
FIG. 4 schematically shows current flow in the inductor of FIG. 3.

Simulated vs. measured characteristics of the inductor in FIG. 3.

| | L @ 27.12 MHz nH | Q @ 27.12 MHz | Q @ 54.24 MHz | Q @ 81.36 MHz |
|---|---|---|---|---|
| simulation | 22.2 | 293 | 411 | 501 |
| measurement | 18 | 65 (*) | NA | NA |

(*) This value is not expected to be accurate because the inductance value falls out of the accuracy chart of our impedance analyzer Agilent E5061B. FIG. 3 is not to scale with respect to the experimental structure, which had outside diameter (OD) = 28 mm, inside diameter (ID) = 13 mm and number of turns N = 4.

Figure 5:
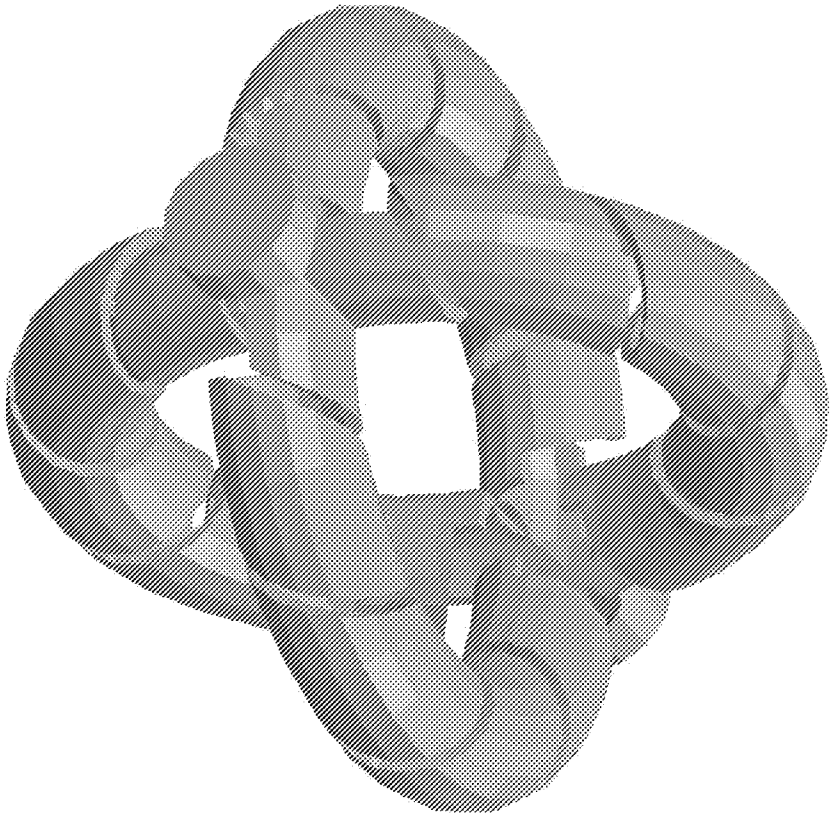
FIG. 5 is a 3D CAD model of a toroid inductor with a round cross section and four parallel windings.

4) A toroid with a round cross section and four parallel windings: As an example of the added flexibility, FIG. 5 shows an inductor design that cannot be implemented in a planar process. The structure of FIG. 5 has four inductive legs that mutually cancel the "one turn" inductance in the respective toroidal planes, reducing disruptive EMI and allowing inductors to be closer together and have a higher quality factor Q for a given inductance value. Even though this solution may not make the best use of volume, it favors the situations where small inductances and high quality factors are required. COMSOL Multiphysics simulations show that there is very little magnetic field inside the empty volume of the inductor which suggest it may be possible to include similar inductive structures within, forming a nested magnetic structure to make better use of the volume.

TABLE V

Simulated vs. measured characteristics of the inductor in FIG. 5.

| | L @ 27.12 MHz nH | Q @ 27.12 MHz | Q @ 54.24 MHz | Q @ 81.36 MHz |
|---|---|---|---|---|
| simulation | 9.3 | 232 | 323 | 392 |
| measurement | 9 | 60 (*) | NA | NA |

(*) This value is not expected to be accurate because the inductance value falls out of the accuracy chart of our impedance analyzer Agilent E5061B. FIG. 5 is not to scale with respect to the experimental structure, which had OD = 21 mm, ID = 10 mm and N = 4.

Figure 6:
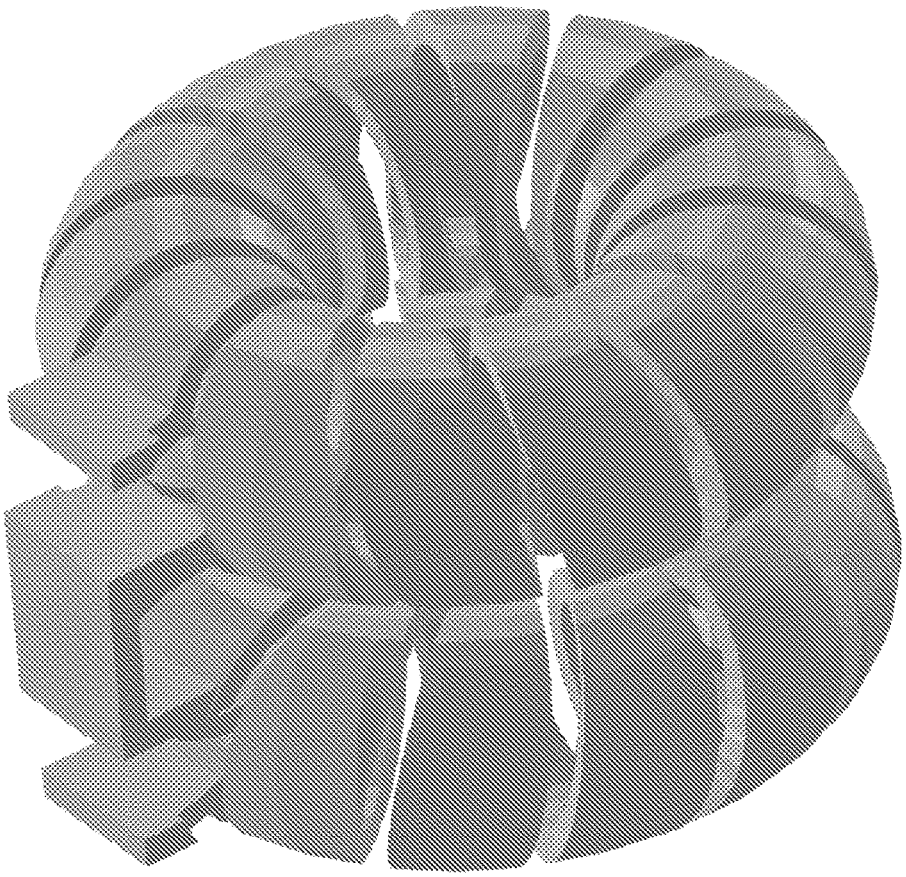
FIG. 6 is a 3D CAD model of two toroid inductor with opposite winding directions in series.

5) "One turn" inductance cancellation with oppositely wound series toroids: There are other ways to eliminate the "one turn" circumferential inductance. For example, FIG. 6 shows two toroidal inductors like the one of FIG. 2 connected in series. The two inductors have the same dimensions and number of turns but the winding goes in opposite directions. By connecting one inductor with opposite windings on top of another, the circumferential current of the two inductors flow in opposite directions. And thus the magnetic field within the inner area of the inductors caused by the circumferential current is cancelled. COMSOL Multiphysics simulations demonstrate the expected cancellation effect.

Figure 7A:
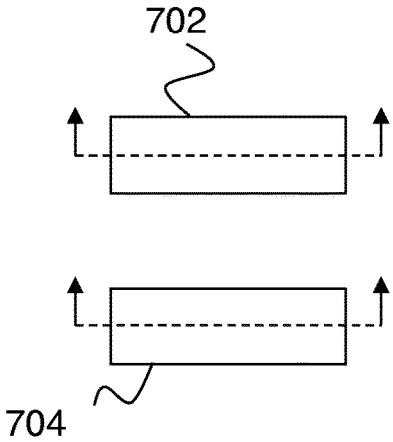
FIGS. 7A-C schematically show current flow in the inductor of FIG. 6.
Figure 7B:
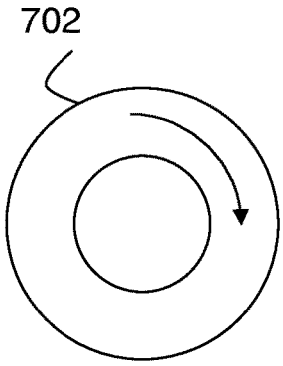
Figure 7C:
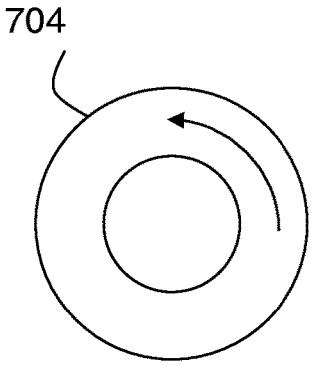

FIGS. 7A-C schematically show the current flow in this example. Here FIG. 7A is a side view of two toroidal coils 702 and 704 in close proximity to each other. FIGS. 7B and 7C are top views of coils 702 and 704, respectively, where the direction of these views is as shown on FIG. 7A. Current flows in opposite directions around toroidal coils 702 and 704 as shown, thereby providing the above-described cancellation of parasitic inductance.

B3) Experiments

The class $\Phi_2$ inverter of FIG. 8 can reduce switch voltage stress by 30%-40% below conventional class E derived converters and has been demonstrated to work efficiently at switching frequencies above 10 MHz. The capacitor $C_S$ blocks the dc component while $L_S$ sets the ac power delivered to the load $R_L$. The remaining components ($L_P$, $L_{MR}$, $C_{MR}$ and $C_P$) form a resonant network having an impedance that shapes the MOSFET's off state voltage waveform to approximate a trapezoid of amplitude of about $2V_{IN}$.

Figure 8:
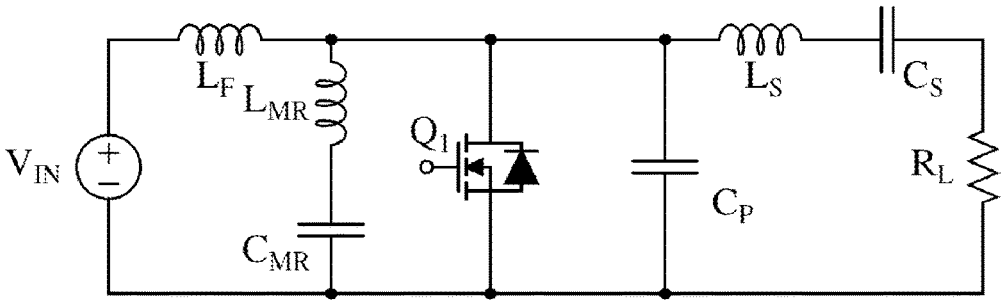
FIG. 8 is a schematic diagram of a class $\Phi_2$ inverter.

To demonstrate an application of the 3D printed air-core inductors described here, a 70 W prototype $\Phi_2$ inverter as in FIG. 8 was designed and implemented. The assembly process associated with the converter involved the following steps: a) Create 3D models of the desired inductor involved in the design, b) Fabricate inductors and characterize impedance values and extract parasitics, c) Connect resonant components to their respective nodes, and d) Add semiconductor and filtering components.

For this initial proof of the concept, the 3D printed inductors were manufactured separately and soldered together. In the future, we expect to be able to print the combined structure with all the air core inductors and resonant capacitors in the circuit in one step, while being able to model the impedance of the structure and extract and/or absorb relevant parasitics into the design. This way, all the resonant passive components will be manufactured together and no further post processing or assembly will be necessary. A 27.12 MHz hard switched gate drive was attached to the inverter and chosen for its simplicity. A self oscillating gate drive scheme is considered for future iterations, to create a fully 3D printed converter with all-in-one 3D printed passive components.

Figure 9:
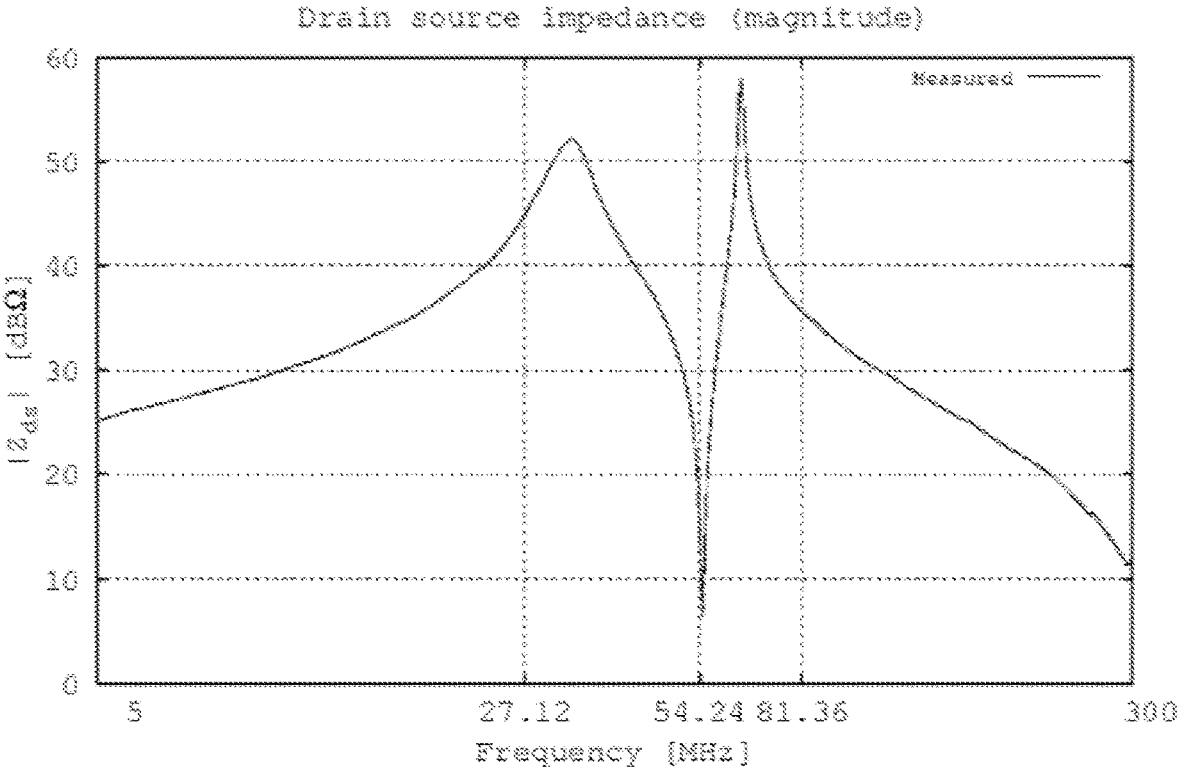
FIG. 9 shows measured MOSFET drain to source impedance of a prototype inverter under bias condition $V_{IN}$=170 V.

The MOSFET in the prototype is a silicon STMicroelectronics STD3NK50ZT4. For the inductors in the circuit, three identical inductors as in FIG. 6 were used for simplicity. Thus, the inverter was not optimized for high efficiency but for ease of manufacturing, considering the turn-around times from the 3D printing companies. But the design was deemed appropriate as a proof of concept. Three types of capacitors are used in the prototype inverter. The input capacitors are two series connected 250 V 1 nF X7R capacitors. The resonant capacitors, $C_{MR}$ (12 pF) and $C_P$ (30 pF) in FIG. 8 were at this point implemented with discrete ceramic capacitors. The larger dc blocking capacitor $C_S$ is a 1.5 nF mica capacitor. The drain to source impedance is measured under the bias condition $V_{in}$=170V and is shown on FIG. 9.

Figure 10:
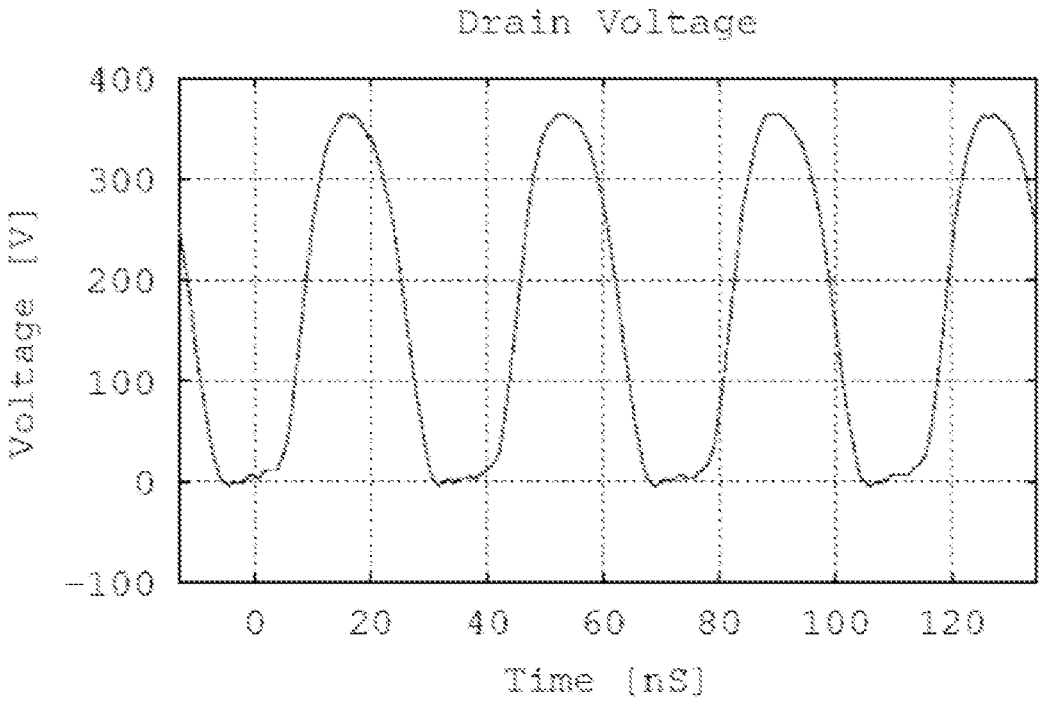
FIG. 10 shows measured MOSFET drain voltage waveform in the experiment of FIG. 9.
Figure 11:
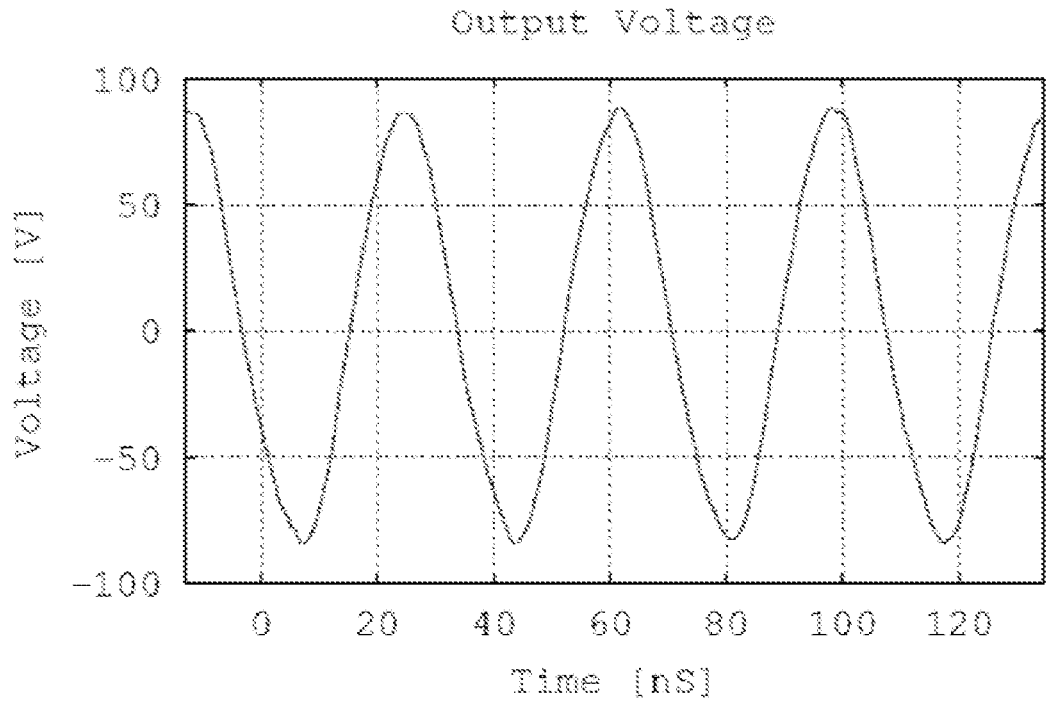
FIG. 11 shows measured output voltage waveform in the experiment of FIG. 9.

The 70 W prototype inverter operates at 27.12 MHz with an input voltage of 170 V. The output of the converter is connected to a 50Ω RF load resistor. Drain and output voltage waveforms are shown on FIGS. 10 and 11 respectively. The efficiency of the inverter reaches 80%.

B4) Conclusion

This section provides several examples of use of 3D printing and molding techniques to add flexibility and functionality in the passive components design as they allow the manufacturing of components with rounded edges and overhanging structures impossible to make with planar processes. In this work, we present several examples of air core inductors designed using 3D printing and molding techniques that give an idea of the geometries that are possible to realize. Moreover, we show that some of these designs can lead to improved electrical performance. We also describe the design tools used by the authors to design, fabricate and characterize the electromagnetic performance of the air core inductors. Toward this goal, we implemented a 70 W prototype 27.12 MHz resonant inverter that incorporates some of the 3D printed components developed for this work. Next steps include improving the precision of the quality factor Q measurement, creative thinking and implementation of better geometries, and investigating alternative ways for metallization. And we envision 3D printing of a combined multi-functional structure that can serve as all the passive components on a high frequency power converter.

Figure 12:
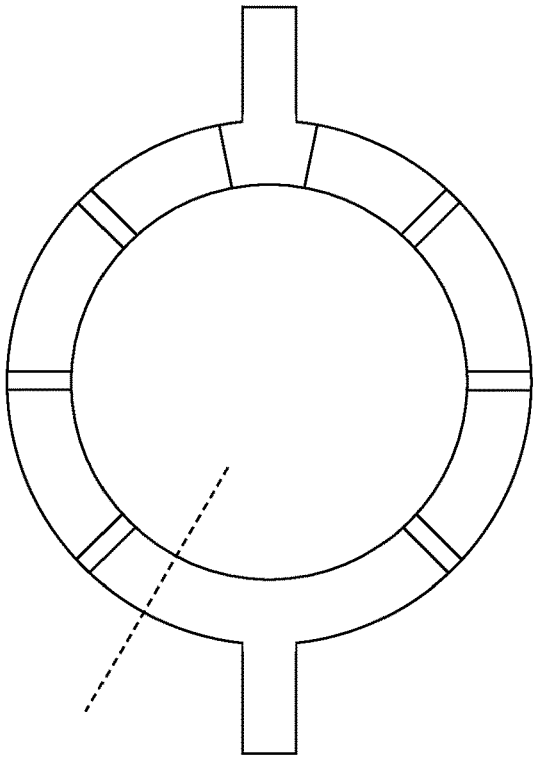
FIG. 12 schematically shows a transformer according to an embodiment of the invention.
Figure 13:
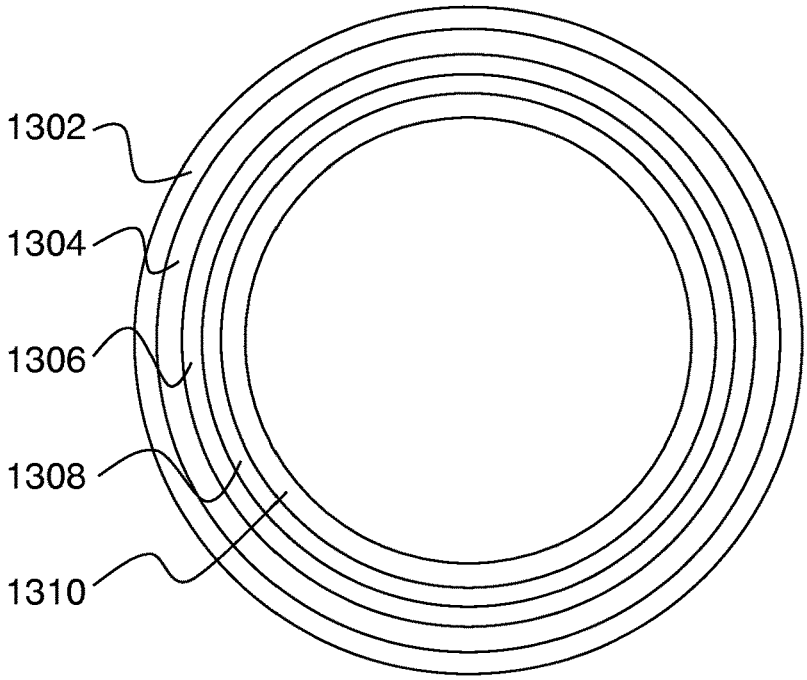
FIG. 13 is a schematic cross section view along the dashed line of FIG. 12.

Although the preceding examples have all related to fabrication of inductors, any kind of passive electrical component can be fabricated according to these principles. FIG. 12 schematically shows an example of a transformer that can be fabricated according to the present approach. FIG. 13 shows a cross section view along the dashed line of FIG. 12. Here 1306 is a conductive primary winding, layers 1304 and 1308 are insulating layers, and layers 1302 and 1310 are conductive secondaries. Such a transformer can be fabricated by precision fabrication of primary 1306 as described above, followed by deposition of the insulating layers 1304 and 1308 and conductive layers 1302 and 1310. In this manner, primary 1306 serves as a scaffold for conformal deposition of the other layers. Since the layers follow the shape of the scaffold (i.e., the deposition is conformal), precise control of the geometry of all layers can be provided by suitable design of the scaffold.

The invention claimed is:

1. A method comprising:

providing a scaffold having one or more surfaces having respectively, one or more predetermined 3-dimensional shapes;

conformally depositing one or more layers on some or all of the surfaces of the scaffold having the one or more predetermined 3-dimensional shapes such that the deposited one or more layers follow a shape of the scaffold and thereby exhibit the one or more predetermined 3-dimensional shapes, wherein the scaffold is configured as a coil; and using the scaffold and the deposited one or more layers to form an electrical component with the one or more layers including a conductive material for a conductive layer and another of the one or more layers including an insulative material for an insulative layer, one of the conductive layer and the insulative layer covering the other of the conductive layer and the insulative layer.

2. The method of claim 1, wherein the coil is a toroidal coil.

3. The method of claim 1, wherein the scaffold is formed by a method selected from the group consisting of: 3-D printing, injection molding, casting and lost wax casting.

4. The method of claim 1, wherein the scaffold is formed by a 3D printing method selected from the group consisting of: fused deposition modeling, stereo-lithography and selective laser sintering.

5. A method comprising:

providing a scaffold having one or more surfaces having respectively, one or more predetermined 3-dimensional shapes;

conformally depositing one or more layers on some or all of the surfaces of the scaffold having the one or more predetermined 3-dimensional shapes such that the deposited one or more layers follow a shape of the scaffold and thereby exhibit the one or more predetermined 3-dimensional shapes, wherein the scaffold is configured as a coil; and using the scaffold and the deposited one or more layers to form an electrical component, wherein the one or more layers include two layers disposed on opposite surfaces of the scaffold, and each of the two layers is a material characterized as being the other of either electrically conductive or electrically insulating.

6. The method of claim 5, wherein the scaffold is an electrically conductive material.

7. A method comprising:

providing a scaffold having one or more surfaces having respectively, one or more predetermined 3-dimensional shapes;

conformally depositing one or more layers on some or all of the surfaces of the scaffold having the one or more predetermined 3-dimensional shapes such that the deposited one or more layers follows a shape of the scaffold and thereby exhibit the one or more predetermined 3-dimensional shapes; and using the scaffold to form one electrically-insulative portion of an electrical component and the one or more layers to form another portion of the electrical component that is not electrically insulative, wherein the scaffold is configured as a coil.

8. The method of claim 7, wherein the scaffold is formed by a method selected from the group consisting of: 3-D printing and injection molding.

9. The method of claim 7, wherein the scaffold is formed by a method selected from the group consisting of: casting and lost wax casting.

10. The method of claim 7, wherein the electrical component includes a coil and wherein the coil, at least in part, corresponds to the deposited one or more layers.

* * * * *